US009078803B2

(12) United States Patent
Duncan et al.

(10) Patent No.: US 9,078,803 B2
(45) Date of Patent: Jul. 14, 2015

(54) LOW EMI FAR INFRARED SAUNA ROOM

(71) Applicants: Raleigh Duncan, San Francisco, CA (US); Andy Kaps, San Francisco, CA (US); Zaihong Jian, Guangdong (CN)

(72) Inventors: Raleigh Duncan, San Francisco, CA (US); Andy Kaps, San Francisco, CA (US); Zaihong Jian, Guangdong (CN)

( * ) Notice: Subject to any disclaimer, the term of this patent is extended or adjusted under 35 U.S.C. 154(b) by 123 days.

(21) Appl. No.: 14/025,124

(22) Filed: Sep. 12, 2013

(65) Prior Publication Data

US 2015/0067958 A1 Mar. 12, 2015

(51) Int. Cl.
*A61H 33/06* (2006.01)
*A61H 33/00* (2006.01)

(52) U.S. Cl.
CPC ..... *A61H 33/005* (2013.01); *A61H 33/06* (2013.01)

(58) Field of Classification Search
CPC ..... A61H 33/06
USPC ..... 4/524–534
See application file for complete search history.

(56) References Cited

U.S. PATENT DOCUMENTS

| | | | | |
|---|---|---|---|---|
| 2010/0017953 | A1* | 1/2010 | O'Keeffe et al. | 4/524 |
| 2013/0145541 | A1* | 6/2013 | Krasilnikov | 4/524 |
| 2013/0226109 | A1* | 8/2013 | Faridoon | 604/290 |
| 2014/0026313 | A1* | 1/2014 | Zaglio | 4/524 |
| 2014/0157511 | A1* | 6/2014 | Shurtleff | 4/524 |
| 2014/0191048 | A1* | 7/2014 | Duncan | 236/1 C |
| 2014/0345041 | A1* | 11/2014 | Barghelame | 4/526 |
| 2015/0040308 | A1* | 2/2015 | Lee | 4/524 |

* cited by examiner

*Primary Examiner* — Lori Baker
(74) *Attorney, Agent, or Firm* — Larisa Migachyov

(57) ABSTRACT

A sauna that reduces EMI emissions in the sauna room by, in the preferred embodiment, passing the AC current through an EMI filter, converting it to DC current, and passing it through another EMI filter to remove any remaining irregularities.

6 Claims, 2 Drawing Sheets

LOW EMI FAR INFRARED SAUNA ROOM

RELATED APPLICATIONS

Figure 1:
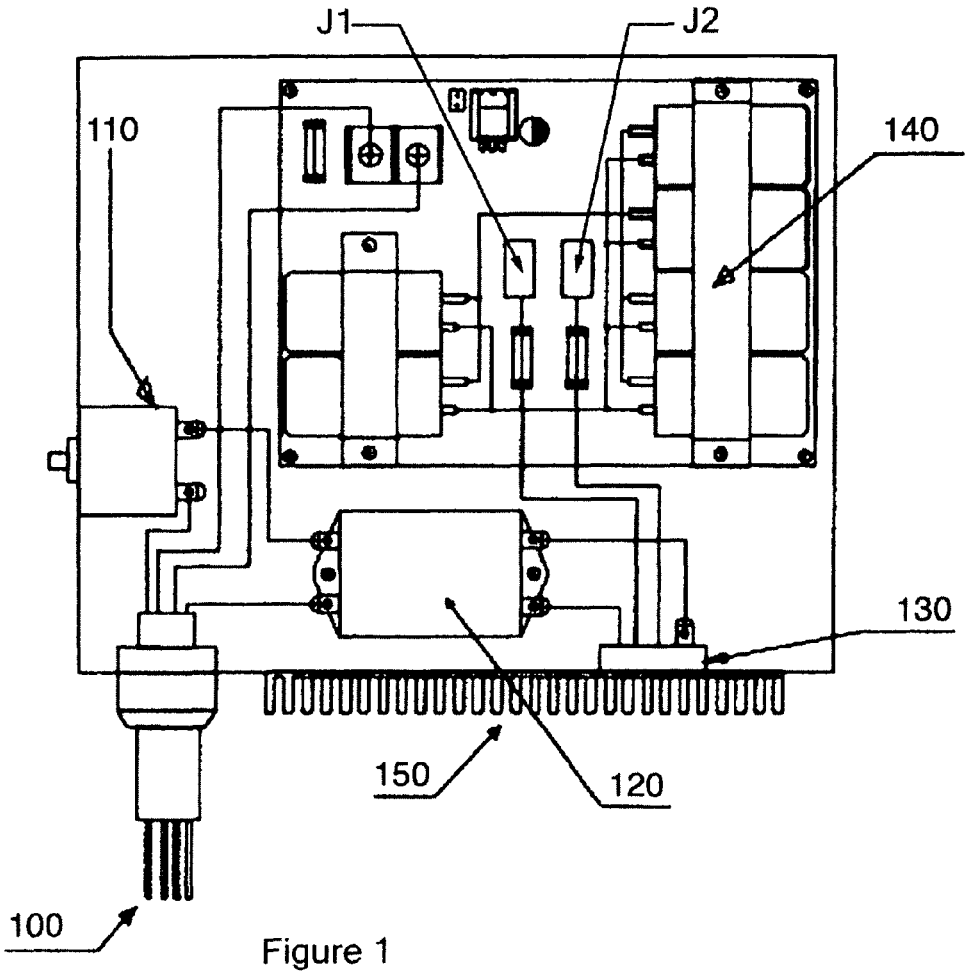

This application claims priority under 35 U.S.C. 119(a) to Chinese Patent No. 2012 2 0471712.8, filed on Sep. 14, 2012 and issued on Apr. 17, 2013.

FIELD OF THE INVENTION

The present invention relates generally to sauna technology, and particularly to low EMI saunas.

BACKGROUND

Various heating devices are used in sauna rooms around the world. Typically, the heaters used for that purpose are mica heaters, carbon fiber heaters, ceramic rods, film heaters, iron heat pipes, light tubes, and so on. These heating appliances usually use 110V-130V or 220V-240V alternating current. Testing shows that this makes these heaters produce electromagnetic radiation at 30 Hz-3 GHz at 10-300 mGs (milligauss). This electromagnetic radiation has undesirable effects on the human body. Neurological effects include headaches, dizziness, pain, fatigue and weakness, insomnia and sleep disturbances, and memory problems; other effects include dry mouth, numbness, and menstrual disturbances in women. In some people, electromagnetic radiation causes increases or decreases in blood pressure, bradycardia or tachycardia, sinus arrythmia, and other cardiovascular effects. It is therefore important to reduce the electromagnetic radiation emitted within a sauna room.

Some sauna designs already address this issue. Some sauna manufacturers put two carbon fiber heaters back to back with the AC current being of opposite phase, so that the electromagnetic waves cancel each other out and reduce the overall electromagnetic radiation emitted by the sauna. However, this kind of sauna still produces an average electromagnetic radiation value that can be as high as 50 mGauss, or even up to 200 mGauss in some cases. This is partly due to the fact that it is difficult to ensure that the two paired heaters are exactly identical in their electromagnetic radiation emissions. If they are not exactly identical, the electromagnetic fields do not fully cancel each other out. Furthermore, not all sauna rooms use carbon fiber heaters—80% of all existing saunas use other technologies, such as heating pipes, mica heaters, light tubes, and other heating devices that cannot be used in this kind of design.

A need therefore exists for a low-EMF sauna room that is not limited to carbon fiber heater technology and that does not require precision manufactured heaters.

SUMMARY OF THE INVENTION

An object of the present invention is to provide a low-EMF sauna room that avoids the detrimental effects of EMF emissions on the human body while providing beneficial heat.

The present invention comprises an AC input, an AC to DC converter circuit, and an EMI filter circuit. The filtered DC current is then used to power at least one heater in a sauna.

In another embodiment, the present invention comprises an AC input, an AC to DC converter circuit, and two EMI filter circuits—a first EMI filter circuit connected between the AC input and the AC to DC converter circuit, and a second EMI filter circuit connected between the DC output of the AC to DC converter circuit and at least one heater in a sauna.

In another embodiment, the AC input, AC to DC converter circuit, and the EMI filter circuit or circuits are located at such a distance from the sauna room that any EMF radiation produced by them is further reduced.

In another embodiment, the present invention can also comprise additional EMF shielding in the sauna room.

DETAILED DESCRIPTION OF THE PREFERRED EMBODIMENT

FIG. 1 shows a structural diagram of the preferred embodiment of the present invention. AC current comes in through AC connector 100. The AC connector is connected, through a fuse 110, to a first-pass EMI filter 120. The first-pass EMI filter is connected to an AC to DC transformer 130, which converts the AC power to DC. After the DC conversion, the signal goes through a second-pass EMI filter 140 to filter the EMI from the DC signal. After that, the DC signal is used to power the heater 150. The AC to DC transformer 130 preferably comprises a heat sink to discharge some of the heat generated by the AC to DC conversion.

The heater 150 can be any type of heater that can provide therapeutic levels of heat for a sauna and that can be powered by DC current. Such a heater can be a heating pipe, mica heater, light tube, carbon fiber heater, or any other heater known in the art of sauna manufacture.

Figure 2:
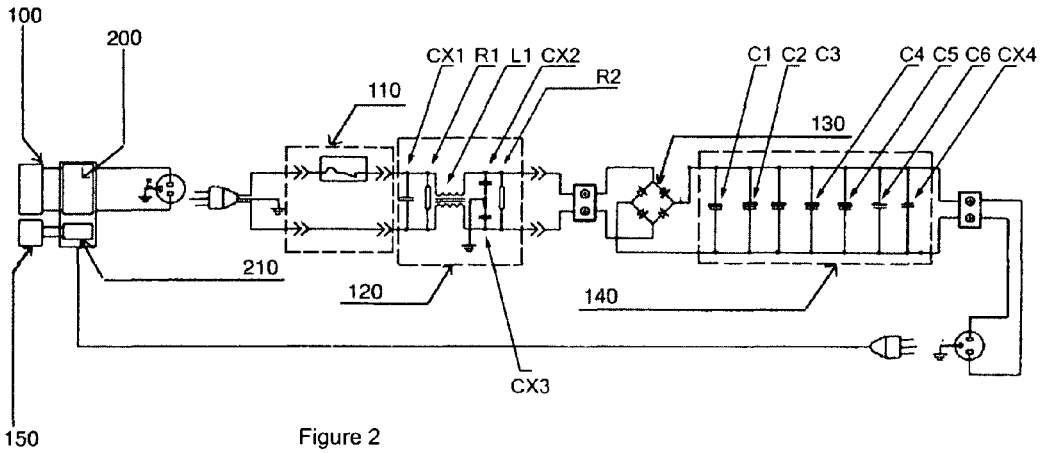

FIG. 2 shows an electrical schematic of the preferred embodiment of the present invention. AC current comes in through an AC power supply 100 and goes through the AC input controller. After going through the fuse 110, the signal goes through the first-pass EMI filter 120. The first-pass EMI filter 120 preferably comprises capacitors CX1, CX2, and CX3, inductor L1, and resistors R1 and R2. The capacitor CX1 is connected in parallel with resistor R1 in between the two ends of the power supply. The inductor L1 input connects to both ends of the capacitor CX1 and resistor R1, and its output connects to the capacitors CX2 and CX3 connected in series, and resistor R2 connected in parallel with the capacitors CX2 and CX3; the circuit is grounded between capacitors CX2 and CX3.

The AC/DC transformer 130 is preferably a full-wave rectifier circuit. The input end of the full-wave rectifier circuit connects to the output end of the inductor L1, and its output end connects to the second-pass EMI filter 140.

The second-pass EMI filter 140 preferably includes at least a filter capacitor and a decoupling capacitor, connected in parallel. The filter capacitor and decoupling capacitor then cross on the output end of the full-wave rectifier circuit. The filter capacitor is a broadband electromagnetic radiation filter, which filters the DC current to smooth it out. The decoupling capacitor is a low-pass power filter. The second-pass EMI filter 140 not only filters out the high-frequency noise of the power grid, but also ensures that the sauna receives pure DC power. This effectively reduces the intensity of the electromagnetic radiation and its hazards to the human body.

In the preferred embodiment, the second-pass EMI filter comprises filter capacitors C1, C2, C3, C4, C5, and C6, and decoupling capacitor CX4. The filter capacitors C1-C6 and decoupling capacitor CX4 are all connected in parallel, as shown in FIG. 2; this ensures that a smooth DC output is obtained.

The sauna preferably also includes an AC input controller 200 that sets AC input levels, a DC output controller 210 that sets DC output levels, or both. The AC input controller 200 is connected between the AC power supply and first-pass EMI filter. The DC output controller 210 is connected between the second-pass EMI filter and the heater or heaters. This ensures that both the AC input and the DC output are set to the correct level.

An overcurrent protection device 110 may be connected between the AC input controller and the EMI filter. Such an overcurrent protection device may be a fuse, a circuit breaker, a temperature sensor, a current limiter, or any other device known in the art to prevent overcurrent.

The present invention reduces the EMI levels within the sauna from 200 mGauss to less than 2 mGauss. This is a much safer level of EMI exposure for the human body.

Those of reasonable skill in the art will realize that some changes and alterations can be made to the embodiment described above while still staying within the scope of the invention. For instance, while specific types of EMI filters are described, any other EMI filters that reduce EMF to safe levels for the human body can also be used either as a first-pass or second-pass EMI filter.

The invention claimed is:

1. A sauna, comprising:

a sauna room comprising at least one heater;

an AC power supply;

a first EMI filter circuit connected to the AC power supply;

an AC to DC converter connected to the first EMI filter circuit, said AC to DC converter comprising an AC input and a DC output, said DC output connected to the at least one heater.

2. The sauna of claim 1, further comprising:

a second EMI filter circuit connected between the DC output and the at least one heater.

3. The sauna of claim 1, where the AC power supply, the first EMI filter circuit, and the AC to DC converter are located outside the sauna room.

4. The sauna of claim 1, where the AC power supply, the first EMI filter circuit, and the AC to DC converter are located at such a distance from the sauna room as to reduce EMF levels within the sauna room by at least a factor of 100.

5. The sauna of claim 1, where the at least one heater is selected from a group comprising: mica heater, light tube, carbon fiber heater, heating pipe.

6. The sauna of claim 1, further comprising EMI shielding.

* * * * *